US006406334B2

(12) United States Patent
Chu

(10) Patent No.: US 6,406,334 B2
(45) Date of Patent: Jun. 18, 2002

(54) COUPLING STRUCTURE FOR A MOBILE VIDEO DEVICE

(76) Inventor: Fa-Yu Chu, 1F, No. 3, Sec. 5 Yen-Ping N. Rd., Shih-Lin Dist., Taipei (TW)

( * ) Notice: Subject to any disclaimer, the term of this patent is extended or adjusted under 35 U.S.C. 154(b) by 0 days.

(21) Appl. No.: 09/810,257

(22) Filed: Mar. 19, 2001

Related U.S. Application Data

(63) Continuation of application No. 09/502,457, filed on Feb. 11, 2000, now Pat. No. 6,250,967.

(51) Int. Cl.[7] ..... H01R 17/18
(52) U.S. Cl. ..... 439/668; 297/217.3
(58) Field of Search ..... 439/131, 534, 439/668, 669, 823, 455, 929; 297/217.3, 217.4

(56) References Cited

U.S. PATENT DOCUMENTS 3,019,050 A * 1/1962 Spielman ..... 297/217.3
4,097,111 A * 6/1978 Martin ..... 439/638
5,267,775 A * 12/1993 Nguyen ..... 297/217
5,387,026 A * 2/1995 Matsuhashi et al. ..... 297/217.4
5,409,403 A * 4/1995 Falossi et al. ..... 439/668
5,482,352 A * 1/1996 Leal et al. ..... 297/217.4
5,507,556 A * 4/1996 Dixon ..... 297/217.3
5,713,633 A * 2/1998 Lu ..... 297/364
5,807,177 A * 9/1998 Takemoto et al. ..... 463/47
6,065,806 A * 5/2000 Iyaguchi et al. ..... 297/362.13
6,089,663 A * 7/2000 Hill ..... 297/258.1
6,179,381 B1 * 1/2001 Gevaert ..... 297/217.3
6,215,518 B1 * 4/2001 Watkins ..... 348/148
6,270,157 B1 * 8/2001 Kapushinski ..... 297/170

* cited by examiner

*Primary Examiner*—Khiem Nguyen
*Assistant Examiner*—Thanh-Tam Le
(74) *Attorney, Agent, or Firm*—Bacon & Thomas

(57) ABSTRACT

Coupling structure for mobile video device provided with a signal terminal having multiple signal contact points as outputs of the mobile video device and provided with a terminal jack disposed in a seat and having multiple signal contact points corresponding to the signal contact points of the signal terminal. The signal terminal can be more easily and quickly inserted into the seat to couple with the terminal jack or extracted therefrom for service. The terminal jack is mounted on a multistage adjustment device so that the height of the mobile video device can be multistage adjusted.

3 Claims, 9 Drawing Sheets

COUPLING STRUCTURE FOR A MOBILE VIDEO DEVICE

CROSS-REFERENCE TO RELATED APPLICATION

This application is a continuation of application Ser. No. 09/502,457, filed on Feb. 11, 2000, now U.S. Pat. No. 6,250,967.

BACKGROUND OF THE INVENTION

The present invention is related to a coupling structure for mobile video device, by which the mobile video device can be more easily installed and extracted. The coupling structure is provided with a multistage adjustment device so that the height of the mobile video device can be multistage adjusted.

Subsequent to the soaring popularity of the personal mobile video device, convenience of maintenance job is considered more important than ever. However, as the wiring in a conventional mobile video device is usually coupled in way of point or cup joint, it would be rather troublesome to open the seat for wire-cutting and wire-connecting when maintaining.

FIG. 1 shows a coupling structure for the conventional mobile video device. A video device C is disposed in a pillow A. A plurality of signal transmission lines C1 penetrate through a branch pipe A1 of the pillow A and then are sleeve-jointed with an adapter C2 which is coupled to a signal transmission line D extended out of a seat B. Another branch pipe A1 is swiveled to lock on a pipe head A2.

The conventional coupling structure has some imperfections as follows:

1. The coupling way of the conventional coupling structure of mobile video device is such that the wires are staggered and connected or the wires are connected by means of an adapter. Such connection procedure is time-consuming and laborious.

2. During maintenance, it is often necessary to draw out the entire set of signal transmission lines and cut the lines for detaching and servicing the mobile video device. Then, the wires are again connected. Such procedure is troublesome and time-consuming.

3. The conventional coupling structure of mobile video device has very poor stability. Therefore, it often takes place that the signal transmission line loosens and detaches.

SUMMARY OF THE INVENTION

It is therefore a primary object of the present invention to provide a coupling structure for mobile video device. The coupling structure includes a signal terminal having multiple signal contact points as outputs of the mobile video device and a terminal jack disposed in a seat and having multiple signal contact points corresponding to the signal contact points of the signal terminal. The signal terminal can be more easily and quickly inserted into the seat to couple with the terminal jack or extracted therefrom for service. The terminal jack is mounted on a multistage adjustment device so that the height of the mobile video device can be multistage adjusted.

The present invention can be best understood through the following description and accompanying drawings wherein:

BRIEF DESCRIPTION OF THE DRAWINGS

FIG. 3-1 is a plane view of an embodiment of the signal terminal of the present invention;

FIG. 3-2 is a plane view of another embodiment of the signal terminal of the present invention;

FIG. 3-3 is a plane view of still another embodiment of the signal terminal of the present invention;

FIG. 4-1 is a plane view of still another embodiment of the signal terminal of the present invention;

FIG. 4-2 is a plane view of still another embodiment of the signal terminal of the present invention;

FIG. 4-3 is a plane view of still another embodiment of the signal terminal of the present invention;

FIG. 4-4 is a plane view of still another embodiment of the signal terminal of the present invention;

FIG. 5-1 is a sectional view showing a connection measure between the signal terminal and the terminal jack of the present invention;

FIG. 5-2 is a sectional view showing another connection measure between the signal terminal and the terminal jack of the present invention.

DETAILED DESCRIPTION OF THE PREFERRED EMBODIMENTS

Figure 2:
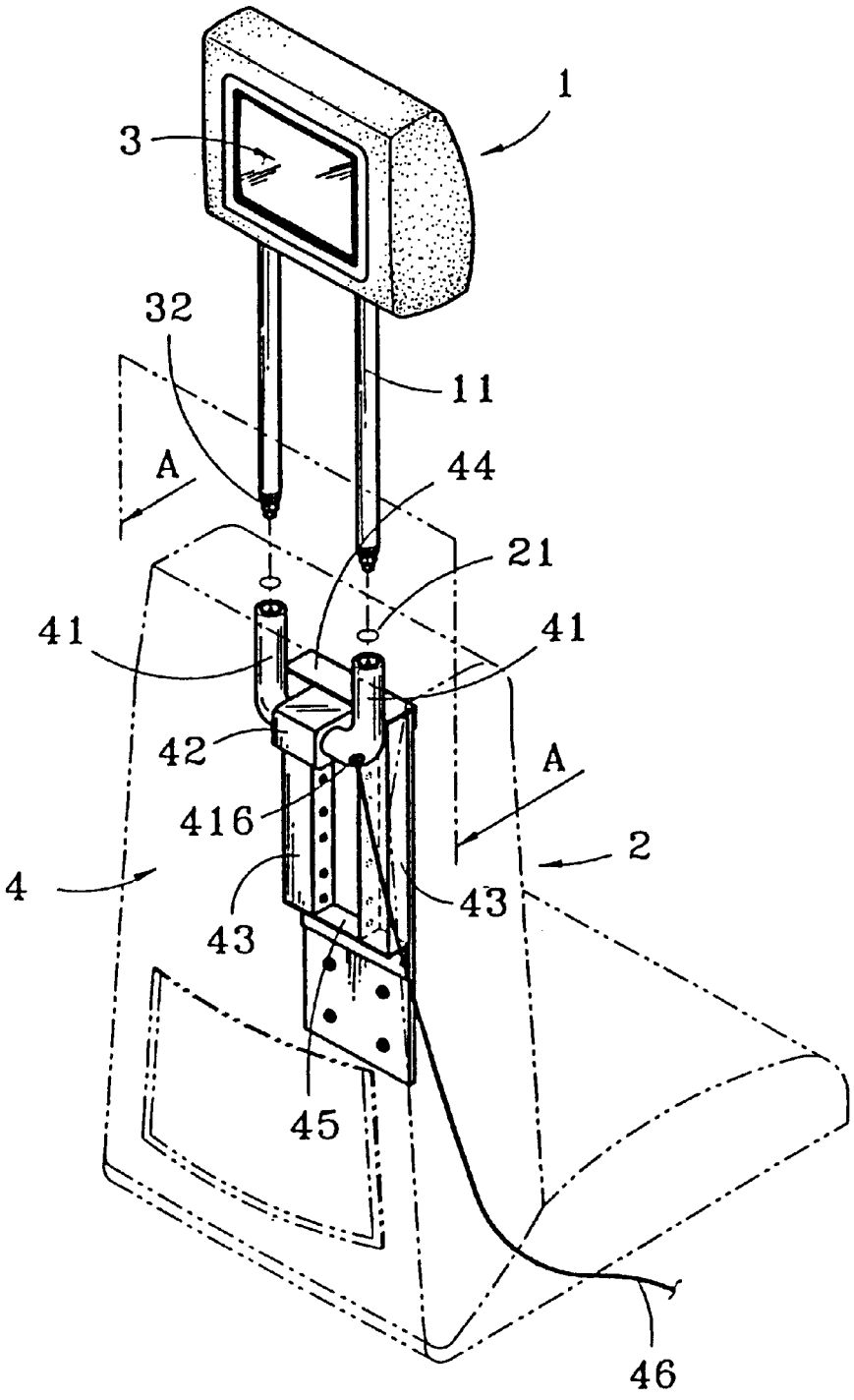
FIG. 2 is a perspective view of the coupling structure of the mobile video device of the present invention.

Please refer to FIG. 2. The mobile video device 3 of the present invention is included in a pillow 1. A signal transmission line 31 of the mobile video device 3 is conducted through the interior of a branch pipe 11 of the pillow 1 and extended to a lower end of the branch pipe 11. The signal transmission line 31 is then coupled with a signal terminal 32 disposed at the lower end of the branch pipe 11. A pair of the branch pipes 11 of the pillow 1 are inserted into two insertion holes 21 formed on upper side of the back of a seat 2. Therefore, the branch pipes 11 are inserted into the back of the seat 2. An adjustment device 4 is disposed in the seat 2, corresponding to and facing the insertion holes 21. A pair of movably adjustable terminal jacks 41 are arranged on the adjustment device 4. When the branch pipes 11 are inserted into the insertion holes 21, the branch pipes 11 are snap-fastened to the terminal jacks 41. The adjustment device 4 includes a displacement block 42 and two displacement rails 43 along which the displacement block 42 is vertically movable. The terminal jacks 41 are retained on the displacement block 42. Therefore, after inserted into the terminal jacks 41, in virtue of the terminal jacks 41 and the displacement block 42, the mobile video device 3 is movable up and down along the displacement rails 43. At an upper and a lower ends of the adjustment device 4, an upper and a lower stoppers 44, 45 are disposed. When extracting the mobile video device 3, the upper stopper 44 serves to stop the displacement block 42 from sliding. The lower stopper 45 enables the signal terminals 32 of the mobile video device 3 to be easily inserted into and engaged with the terminal jacks 41. An exit hole 416 is formed at a bottom end of the terminal jack 41 for extending a signal transmission line 46.

Figure 1:
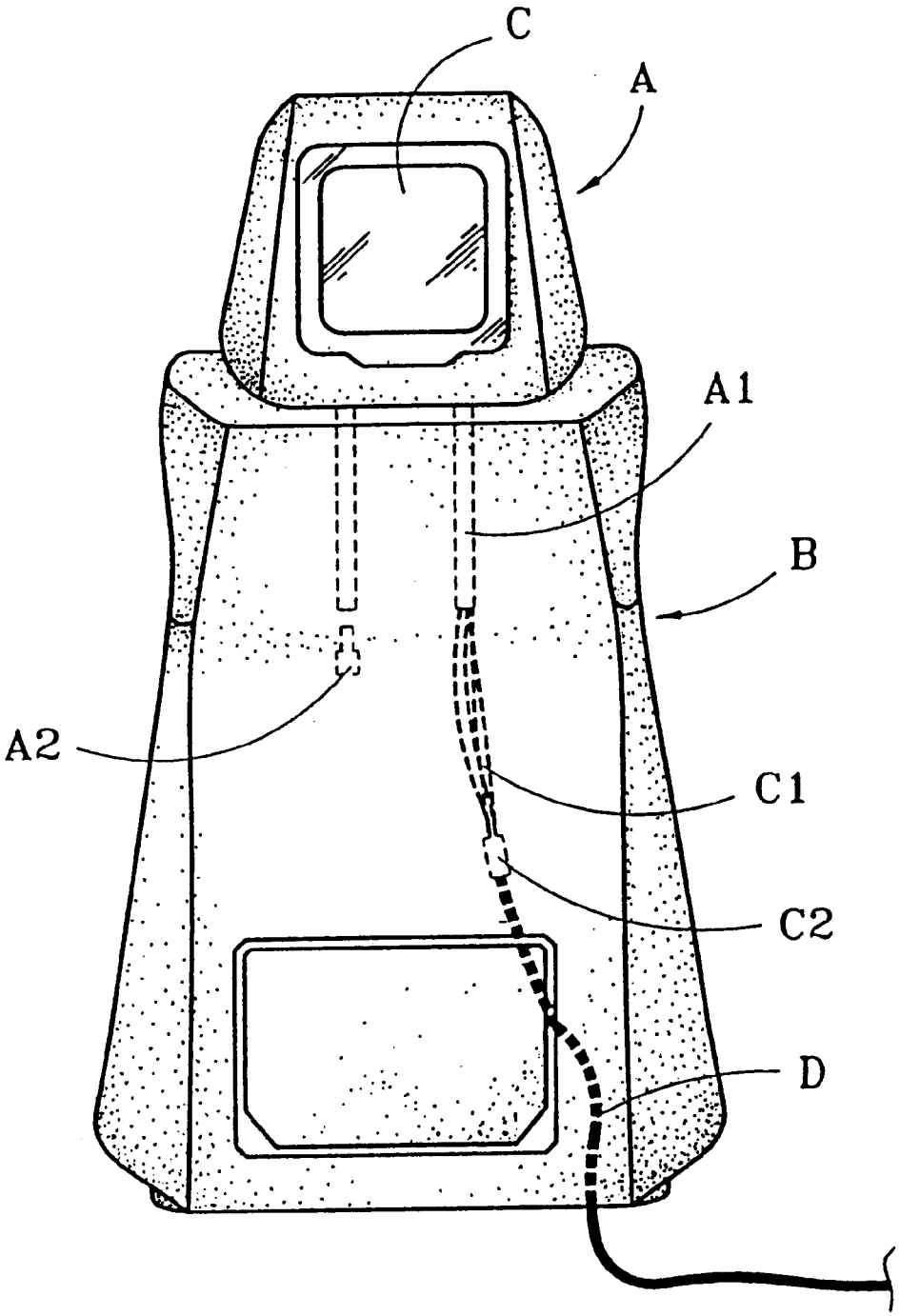
Fig. 1 (Prior Art)
FIG. 1 is a schematic diagram showing the coupling structure of a conventional mobile video device.
Figures 1, 3:
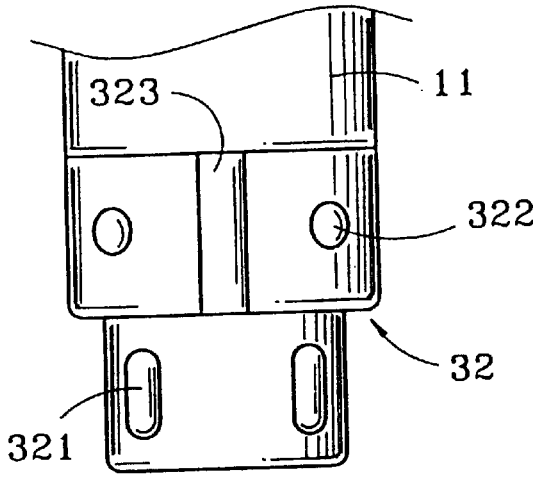
Figures 2, 3:
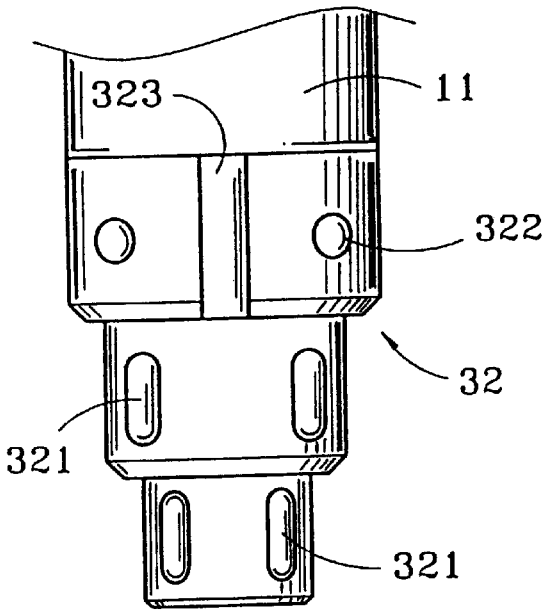
Figure 3:
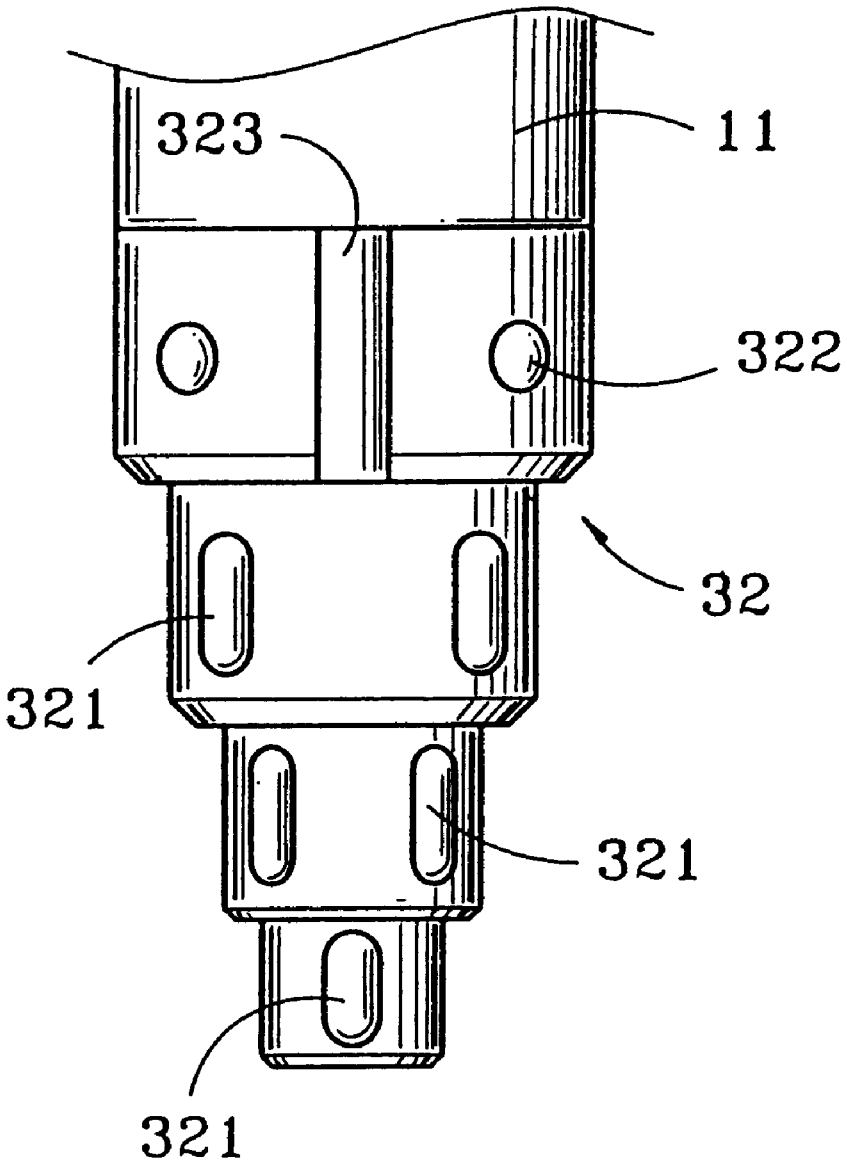
Figures 1, 4:
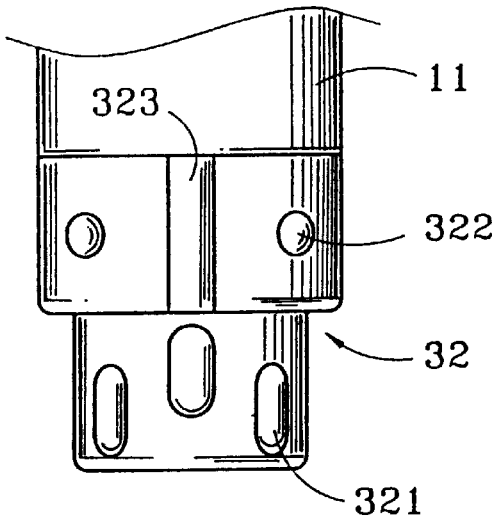
Figures 2, 4:
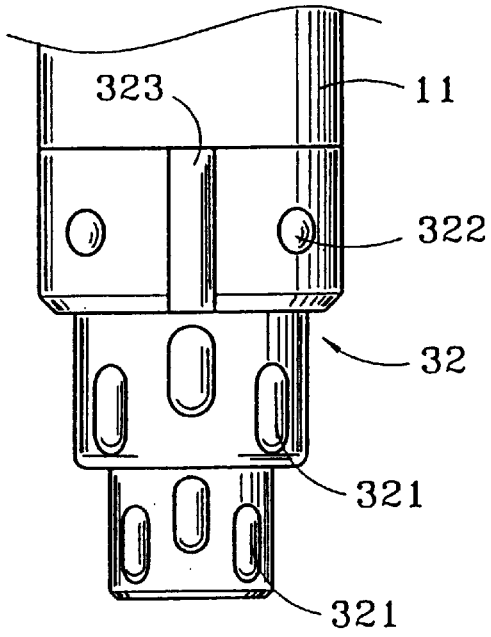
Figures 3, 4:
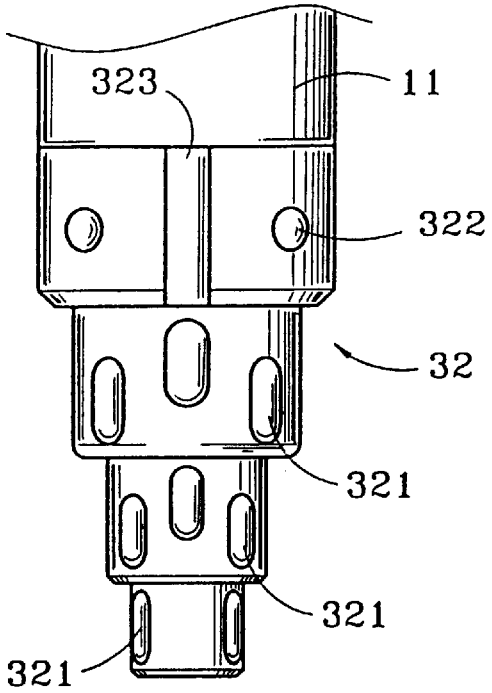
Figure 4:
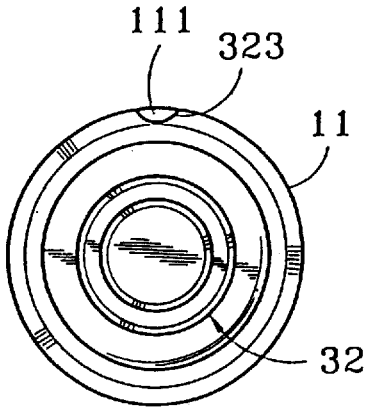

Referring to FIGS. 3-1 to 3-3 and 4-1 to 4-4, a plurality of signal contact points 321 are offered to each of the signal terminals 3 according to requirement of the increasing functions of the mobile video device 3. The signal terminal 32 is elongated in form of a multi-layer structure for accommodating the contact points 321, which may be aligned horizontally or staggeringly, and a plurality of receptacles or slots 322 are also arranged in the signal terminal 32. A positioning groove 323 is formed in the signal terminal 32, and a positioning piece 111 is disposed on the branch pipes 11 to facilitate wiring of the signal terminal 32 correctly and prevent the signal terminal 32 from causing a short circuit because of improper swiveling. One or two sets of the signal terminals 32 may be arranged depending on functions provided by the mobile video device 3.

Figures 1, 5:
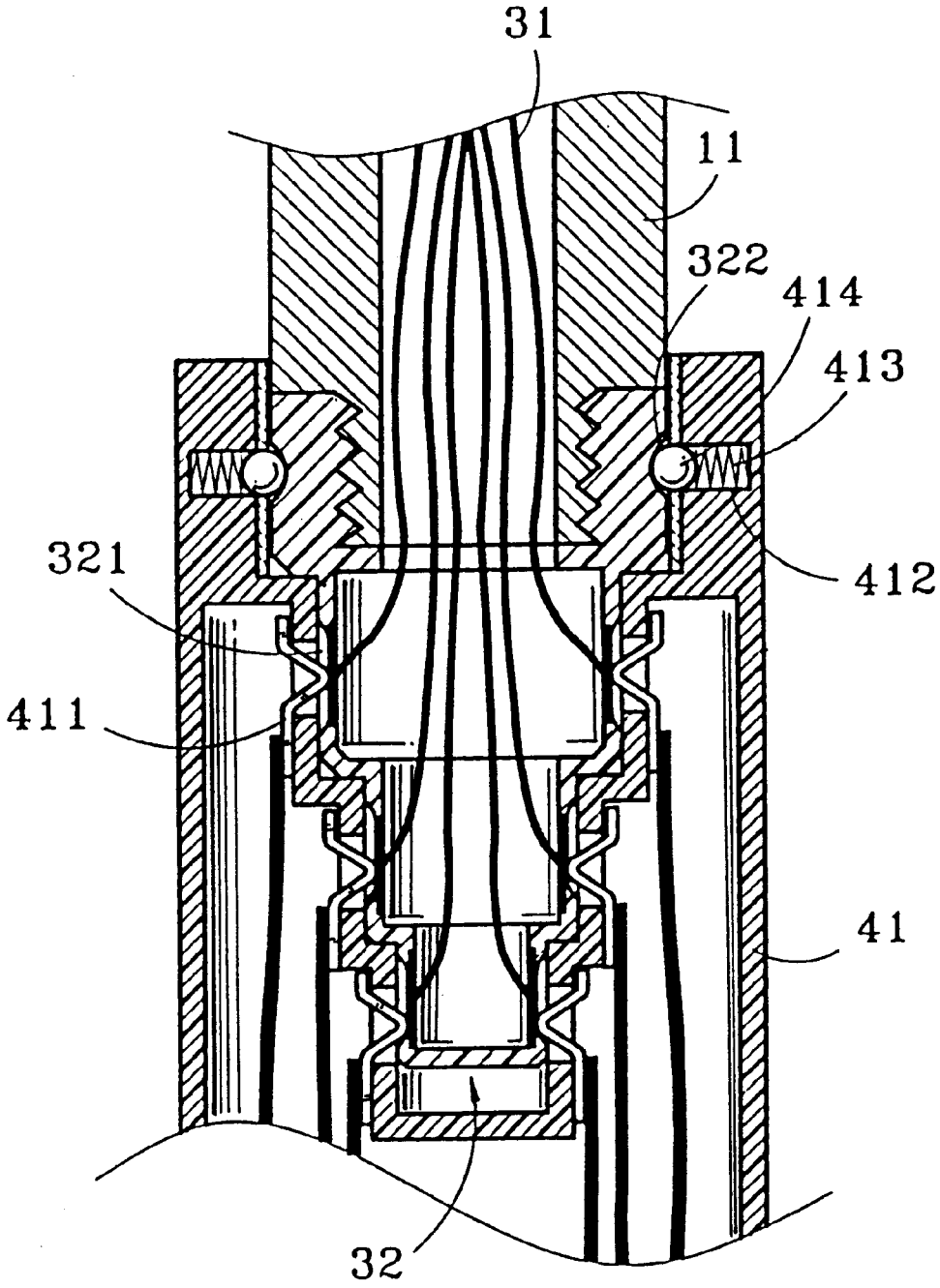
Figures 2, 5:
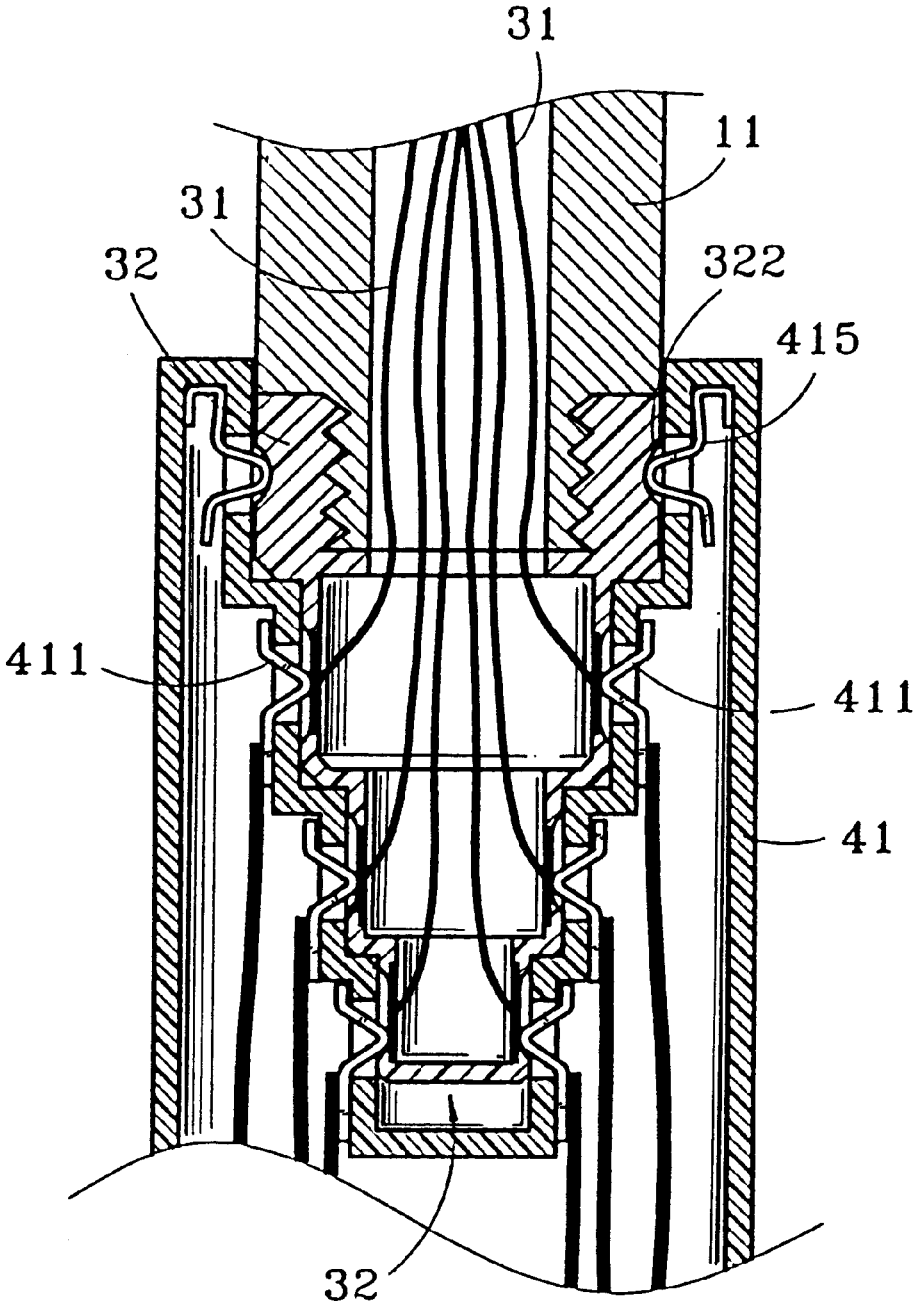

As shown in FIGS. 5-1 and 5-2, a plurality of storage receptacles 412 are formed in the inner wall of the terminal jack 41, wherein an elastic body 413 and a steel bead 414 are buried in the storage receptacle 412 in sequence. A plurality of positioning dimples 322 are formed on the signal terminal 32 at positions corresponding to the storage receptacles 412 of the terminal jack 41. Therefore, the steel bead 414 of the terminal jack 41 is pushed by the elastic body 413 into the positioning dimple 322 of the signal terminal 32 when the terminal 32 is plugged to joint with the terminal jack 41, whereby a short circuit due to improper swivel of the signal terminal 32 can be avoided. At this moment, the signal contact point 321 of the signal terminal 32 is in conductive contact with a signal contact point 411 of the terminal jack 41.

In another way of coupling the signal terminal 32 with the terminal jack 41, a plurality of elastic pieces 415 are disposed in the inner wall of the terminal jack 41 and a plurality of positioning dimples 322 are formed on the signal terminal 32 at positions corresponding to the elastic pieces 415. Hence, the elastic piece 415 is snap-retained in the positioning dimple 322 when the signal terminal 32 is plugged to joint with the terminal jack 41. At this time, the signal contact point 321 of the signal terminal 32 is in conductive contact with the signal contact point 411 of the terminal jack 41.

Figure 6:
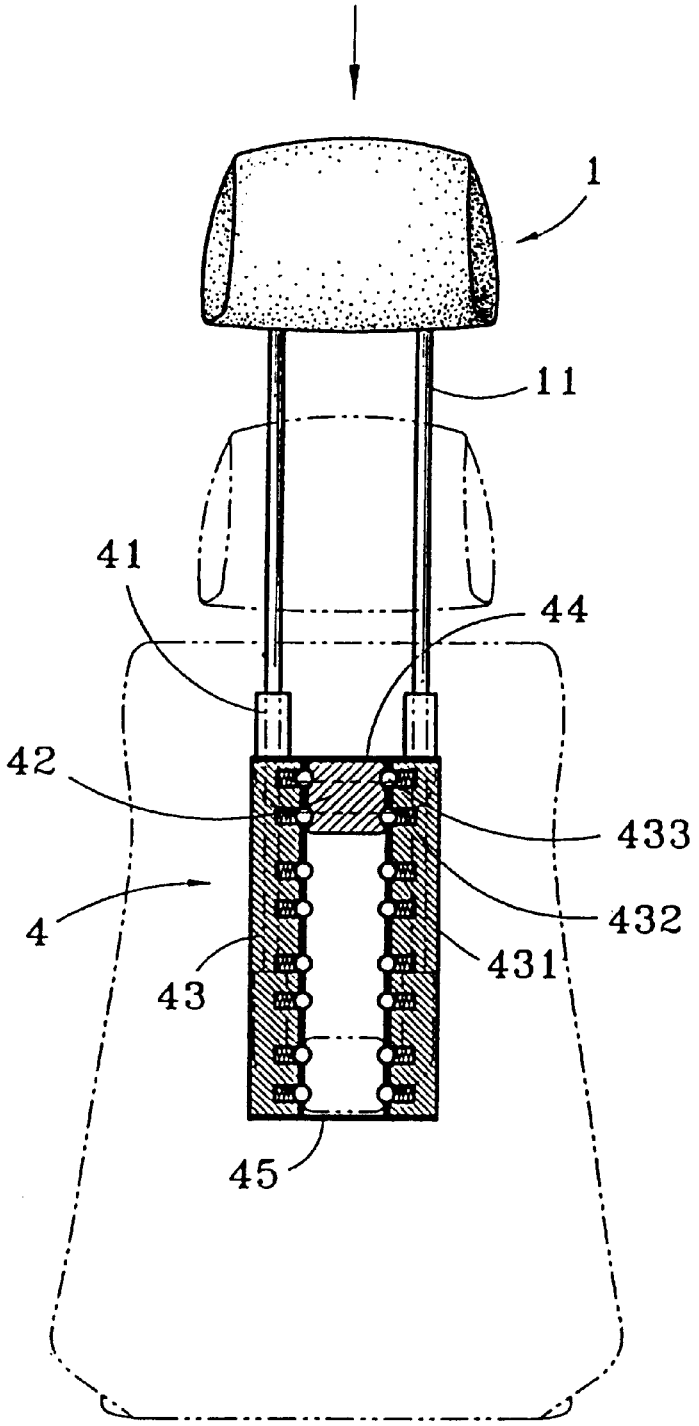
FIG. 6 is a sectional view showing the adjustment device of the present invention.

In FIG. 6, after the signal terminals 32 have been snap-retained in the terminal jacks 41 of the adjustment device 4, the mobile video device 3 is movable up and down along the displacement rails 43 by means of the displacement block 42. As aforesaid, at the upper and lower ends of the adjustment device 4, the upper and lower stoppers 44, 45 are disposed. When extracting the mobile video device 3, the upper stopper 44 serves to stop the displacement block 42 from sliding. The lower stopper 45 enables the signal terminals 32 of the mobile video device 3 to be easily inserted into and engaged with the terminal jacks 41. An exit hole 416 is formed at the bottom end of the terminal jack 41 for extending the signal transmission line 46. Furthermore, a plurality of positioning dimples 421 are disposed at two lateral lines properly in the displacement block 42, while a plurality of storage receptacles 431 are formed in those two displacement rails 43. An elastic body 432 and a steel bead 433 are buried in each storage receptacle 431 sequentially. Hence, the height of the pillow 1 of the mobile video device 3 can be adjusted as desired.

The present invention has the following advantages:

1. The coupling structure of the mobile video device of the present invention makes it easier to connect the signal terminal with the terminal jack.

2. When maintained or serviced, it is unnecessary to drawn out the entire set of signal line. Instead, the signal terminal of the mobile video device can be directly extracted from the terminal jack. Without cutting line, the entire set of mobile video device can be detached for service. Then, the signal terminal of the mobile video device is again plugged into the terminal jack. Such procedure is quite easy and convenient.

3. The signal line of the mobile video device will not detach or drop due to improper wiring. Therefore, a stable signal transmission can be achieved.

In conclusion, the present invention provides a coupling structure that is more advantageous for installing and maintaining a mobile video device. The signal terminal has multiple contact points and the terminal jack cooperatively has multiple contact points. By means of the adjustment device, the height of the mobile video device can be multistage adjusted.

The above embodiments are only used to illustrate the present invention, not intended to limit the scope thereof. Many modifications of the above embodiments can be made without departing from the spirit of the present invention.

What is claimed is:

1. Coupling structure for mobile video device buried in a pillow, said coupling structure being characterized in that a signal transmission line of the mobile video device is conducted through an interior of a branch pipe of the pillow and extended to a lower end of the branch pipe, the signal transmission line being then coupled with a signal terminal disposed at the lower end of the branch pipe, a pair of the branch pipes of the pillow being inserted into two insertion holes formed on upper side of a seat, a terminal jack being disposed in the seat, corresponding to and facing the insertion holes, whereby when the branch pipes are inserted into the insertion holes, the signal terminals are snap-fastened to the terminal jacks so as to easily locate the mobile video device on the seat for signal transmission, wherein the terminal jacks are slidably mounted on an adjustment device fixedly disposed in the seat, whereby the terminal jacks can be moved up and down along the adjustment device.

2. Coupling structure for mobile video device as claimed in claim 1, wherein the signal terminal is provided with multiple sets of signal contact points.

3. Coupling structure for mobile video device as claimed in claim 1, wherein the signal terminal is lengthened to have multiple sets of signal contact points and to form a multi-layer signal terminal, the signal contact points being aligned horizontally or staggeringly to enhance transmission capacity of the mobile video device.

* * * * *